US005616057A

United States Patent [19]

Sundholm

[11] Patent Number: 5,616,057

[45] Date of Patent: Apr. 1, 1997

[54] SHIP

[76] Inventor: Göran Sundholm, Ilmari Kiannon kuja 3, Fin-04310 Tuusula, Finland

[21] Appl. No.: 549,834

[22] PCT Filed: May 4, 1994

[86] PCT No.: PCT/FI94/00170

§ 371 Date: Nov. 3, 1995

§ 102(e) Date: Nov. 3, 1995

[87] PCT Pub. No.: WO94/25341

PCT Pub. Date: Nov. 10, 1994

[30] Foreign Application Priority Data

May 5, 1993 [FI] Finland ..... 932036

[51] Int. Cl.[6] ..... B63H 11/00

[52] U.S. Cl. ..... 440/39; 169/62

[58] Field of Search ..... 440/39, 88, 89; 169/62

[56] References Cited

U.S. PATENT DOCUMENTS 3,339,516 9/1967 Lenci .
3,613,630 10/1971 Jacuzzi .
4,133,284 1/1979 Holcroft .

FOREIGN PATENT DOCUMENTS

93/25276 12/1993 WIPO .

*Primary Examiner*—Jesus D. Sotelo
*Attorney, Agent, or Firm*—Ladas & Parry

[57] ABSTRACT

In a ship having water-ejection for driving the ship and spraying water, the water-ejection for the spraying of the water is improved by spraying the water as a fog of droplets, whereby to cool the ship and protect the ship from radioactive fallout.

3 Claims, 1 Drawing Sheet

SHIP

Figure 1:
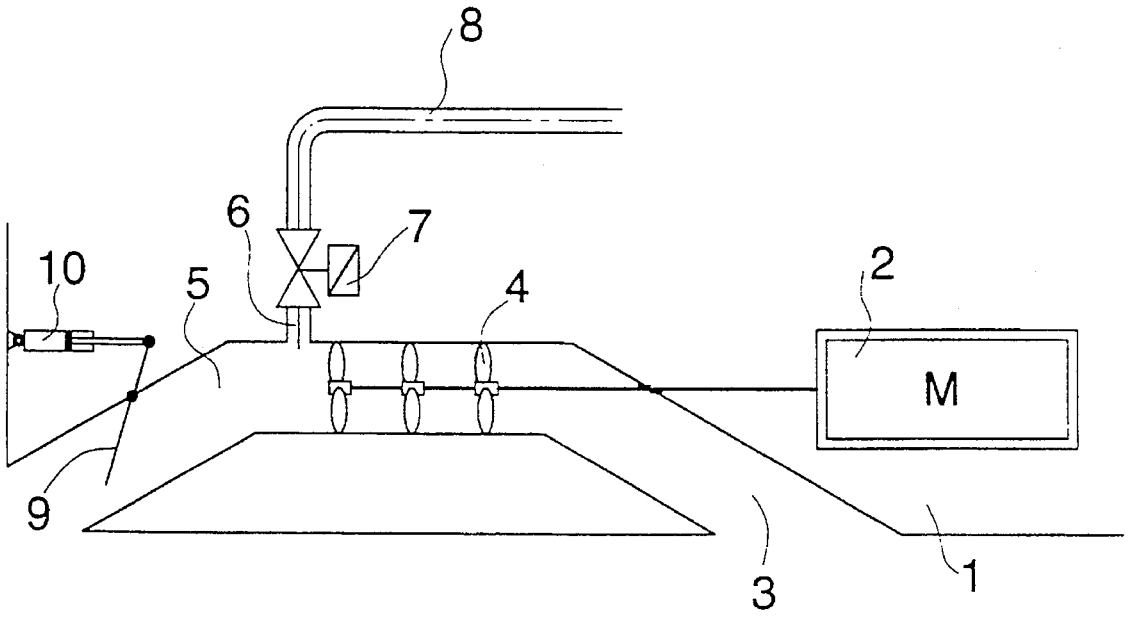

The present invention relates to a ship which is driven by ejecting a water jet.

The object of the invention is to provide a new ship of this type, in which the pressure of the water jet driving the ship is utilized in a new way.

The invention is mainly characterized in that to the ejector space is connected an out-take to one or a plurality of such installations in the ship which for operation require water.

In a preferable embodiment of the invention said out-take is connected to a sprinkler installation or another fire fighting installation in the ship.

In another preferable embodiment of the invention, for fire fighting ships, said out-take is connected to the water guns of the ship. In addition, the out-take can be connected to an installation of spray heads for producing a fog for cooling the ship, enabling the fire fighting ship to closely approach the fire in question.

The last-mentioned embodiment can for military purposes be used, with advantage, to confuse attacking missiles which go for their target on the basis of the heat radiation of the target, or to protect the ship against radioactive downfall.

For all these applications one can utilize the drive machinery of the ship which has a great power; no separate drive units, such as pumps etc., are needed.

The invention shall in the following be described with reference to the attached drawing which schematically illustrates the basic concept of the invention.

In the drawing the reference numeral 1 indicates a bottom part of a ship's hull and the reference numeral 2 indicates the engine of the snip. A water intake is indicated by 3 and a number of propellers, driven by the engine 2, in the water intake channel are indicated by 4.

The propellers 4 drive the water, taken in, out via an ejector space or an ejector channel 5 in which usually prevails an at least proportionally high water pressure. To the ejector space 5, preferably close to the propellers 4, is connected an out-take 6, which via a valve 7 continues in a feed line 8.

The feed line 8 can be connected to a sprinkler installation or to another fire fighting installation in the ship, or to the water guns of a fire fighting ship.

in addition, the line 8 can be connected to an installation of spray heads for producing a fog of small droplets cooling the ship, due to which the fire fighting ship can drive close to a respective fire seat.

The last-mentioned embodiment can for military purposes be used, with advantage, to confuse attacking missiles which go for their target on the basis of the heat radiation of the target, or to protect the ship against radioactive downfall.

In the ejector channel 5 can be arranged a throttle plate 9 which can be maneuvred e.g. by means of a working cylinder 10. By means of the throttle plate 9, when the valve 7 has been opened to take out water to the line 8, the speed of the ship can be lowered or the ship can stopped altogether, and at the same time the water pressure can be raised in the ejector space 5.

I claim:

1. In a ship having water-ejecting means for driving the ship and spraying water, the improvement of the water-ejecting means for the spraying of the water, comprising:

means for the spraying of the water as a fog of droplets, whereby to cool the ship and protect the ship from radioactive fallout.

2. A ship which is driven by ejecting a water jet and comprising an ejector space having an out-take connected thereto to which are connected spray heads producing a fog for cooling the ship.

3. A ship which is driven by ejecting a water jet and comprising an ejector space having an out-take connected thereto to which are connected spray heads producing a fog for protecting the ship against radioactive fallout.

* * * * *